United States Patent [19]

Rikli

[11] Patent Number: 4,843,968

[45] Date of Patent: Jul. 4, 1989

[54] OVERHEAD CABLE TRANSPORT INSTALLATION CONTAINING A TRANSFER SECTION EQUIPPED WITH A CLOCK CONVEYOR

[75] Inventor: Christian Rikli, Hünibach, Switzerland

[73] Assignee: Von Roll Transportsysteme AG, Thun, Switzerland

[21] Appl. No.: 132,898

[22] Filed: Dec. 14, 1987

[30] Foreign Application Priority Data

Dec. 18, 1986 [CH] Switzerland ..... 5105/86

[51] Int. Cl.[4] ..... B60B 11/00

[52] U.S. Cl. ..... 104/27; 104/18; 104/28; 104/173.1

[58] Field of Search ..... 104/18, 20, 25, 27, 104/28, 29, 30, 31, 91, 172.4, 173.1, 173.2

[56] References Cited

U.S. PATENT DOCUMENTS

| | | | |
|---|---|---|---|
| 3,552,321 | 1/1971 | Priebe | 104/18 |
| 3,799,060 | 3/1974 | Johnson | 104/18 |
| 4,602,566 | 7/1986 | Kernkamp et al. | 104/91 |
| 4,627,361 | 12/1986 | Tarasoff | 104/28 |

FOREIGN PATENT DOCUMENTS 0170587 2/1986 European Pat. Off. .

*Primary Examiner*—Richard A. Berisch

*Attorney, Agent, or Firm*—Cushman, Darby & Cushman

[57] ABSTRACT

At a station of an overhead cable transport installation, such as an aerial cableway, wherein the disembarking section is connected with the embarking section by a transfer section, a revolving clock conveyor travels along the transfer section. This clock conveyor is provided with entrainment members arranged thereat at a predeterminate spacing from one another and the clock conveyor is driven by the drive of a revolving cable. A further revolving conveyor travels substantially parallel to the clock conveyor along the transfer section. This further revolving conveyor is equipped with a multiplicity of driver elements distributed over the length thereof and which possesses a somewhat smaller revolving velocity than the clock conveyor. If a vehicle arrives at the transfer section ahead of time in relation to an entrainment member of the clock conveyor then this vehicle is moved further by one of the driver elements of the further conveyor until the intended entrainment member for the early arriving vehicle catches up with such vehicle and entrains the latter. The further conveyor thus prevents that vehicles positioned at the transfer section will come to standstill and specifically also in those situations when a vehicle arrives too late at the transfer section in relation to an entrainment member. In this way there can be avoided disturbances which might arise due to undesired collision of a trailing vehicle with a preceding vehicle along the transfer section.

11 Claims, 2 Drawing Sheets

OVERHEAD CABLE TRANSPORT INSTALLATION CONTAINING A TRANSFER SECTION EQUIPPED WITH A CLOCK CONVEYOR

CROSS-REFERENCE TO RELATED APPLICATIONS

This application is related to the commonly assigned, co-pending U.S. application Ser. No. 07/061,623, filed June 15, 1987, and entitled "overhead Cable Transport Installation, Especially Aerial Cableway", and the likewise commonly assigned, co-pending U.S. application Ser. No. 07/132,897, filed Dec. 14, 1987 and entitled "Overhead Cable Transport Installation Containing a Transfer Section Between a Disembarking Section and an Embarking Section".

BACKGROUND OF THE INVENTION

The present invention relates to a new and improved construction of an overhead cable transport installation, especially an aerial cableway.

Generally speaking, the overhead cable transport installation of the present development, especially the aerial cableway, is of the type comprising vehicles which are continuously moved along a disembarking or exiting section or path, an embarking or entry section or path and a transfer section or path which operatively interconnects the disembarking section or path with the embarking section or path. The vehicles, after arriving at the transfer section, are each operatively engaged by a respective entrainment member of a revolvingly or circulatingly driven clock conveyor and then transferred to the embarking section or path.

In the case of overhead cable transport installations there generally exists the problem that the travelling transport cable, functioning at least as a traction element for the vehicles which are operatively coupled with the cable, alters its length both under the influence of temperature fluctuations and due to changes in loads, for instance caused by changes in passenger traffic frequency during the course of operation of the overhead cable transport installation. These length changes of the cable cause a change in the mutual spacing between neighboring vehicles. Since the cable has a predetermined revolving or circulating velocity, there thus is disturbed the so-called clock, in other words the predetermined time interval between successive vehicles.

Hence, the clock conveyor provided for certain existing aerial cableways is assigned the task of re-establishing the clock or time interval between successive vehicles during passage of the vehicles through one of the stations. This is accomplished by correcting the geometric spacing or mutual distance between neighboring vehicles. Of course, the change in the mutual position or spacing of the arriving or inbound vehicles, caused by changes in the length of the cable, can lead to the result that at the transfer section or path, to which the vehicles are transferred by the conveying means of the disembarking section or path, undesirably come to a state of standstill before they are engaged by an entrainment member of the clock conveyor. Hence, such clock conveyor must thus accelerate a vehicle, when engaged by an entrainment member thereof, from a standstill or stationary state. It will be appreciated that such, in turn, requires at least an appropriately sturdy dimensioning or design of the clock conveyor as well as an appropriate design of the delivered output power of the drive for the clock conveyor.

During the shifting of the mutual position or, what also may be termed the phase of the vehicles, there also can arise the situation that a vehicle arrives too late at the transfer section or path, in other words, directly behind an entrainment member of the clock conveyor. When this happens such entrainment member travels in an empty state or condition, in other words without entraining the vehicle, through the transfer section. It will be recognized that the left behind vehicle will first then be pushed along and out of the transfer section by a trailing vehicle which is engaged by a further entrainment member. When such an operating condition arises then the aerial cableway must be shut down in order to shunt out or remove the vehicle causing the disturbance.

SUMMARY OF THE INVENTION

Therefore with the foregoing in mind it is a primary object of the present invention to provide a new and improved construction of an overhead cable transport installation which does not suffer from the aforementioned drawbacks and shortcomings of the prior art.

Another and more specific object of the present invention aims at the provision of a new and improved construction of an overhead cable transport installation, which, while ensuring for the transport of the vehicles through the transfer section or path, positively affords reliable transfer of the vehicles to predeterminate entrainment members of the clock conveyor and in a relatively impact or surge-free fashion.

Still a further significant object of the present invention is directed to a new and improved construction of an overhead cable transport installation, especially an aerial cableway, containing a transfer section equipped with a clock conveyor, wherein expedients are provided for maintaining in motion a vehicle which has arrived prematurely at the transfer section until the entrainment member contemplated to coact with such vehicle can catch up with, engage and continue to move such still moving vehicle through the transfer section.

Yet a further significant object of the present invention is directed to an improved construction of an overhead cable transport installation which is relatively simple in construction and design, extremely reliable in operation, not readily subject to breakdown and malfunction and requires a relatively minimum amount of maintenance and servicing.

A further noteworthy object of the present invention is to provide a novelly constructed transfer section or path at an overhead cable transport installation which ensures that the vehicles located at the transfer section or path will not undesirably collide with one another to thus minimize down time of the overhead cable transport installation.

Now in order to implement these and still further objects of the invention, which will become more readily apparent as the description proceeds, the overhead cable transport installation, especially the aerial cableway of the present development, is manifested by the features that there is provided at least at one of the stations along the transfer section or path a further conveyor which coacts with the vehicles. This further conveyor possesses a vehicle conveying velocity which differs from the revolving or circulating velocity of the clock conveyor, so that an entrainment member of the clock conveyor can be moved in a predeterminate relationship with respect to the velocity of vehicle movement when located at the transfer section, so that the entrainment member and vehicle on the transfer section can be brought into interacting or interengaging relationship. Thus, advantageously, the entrainment member can overtake a vehicle located at the transfer section or path and engage such vehicle.

Since the further conveyor transports the vehicles which have arrived at the transfer section or path independent of their mutual position or phase, and thus desirably maintains these vehicles in motion, the entrainment members of the clock conveyor can engage these vehicles practically without there arising any surges or impacts, since only slight differences are required between the revolving or circulating velocity of the clock conveyor and the conveying velocity of the further conveyor.

The further conveyor is preferably constructed such that it can transport the vehicles throughout the entire transfer section or path. As a result there is available practically the entire length of the transfer section or path for the operative interconnection or joining together of a vehicle with the entrainment member of the clock conveyor and which was intended for such vehicle. The overhead transport installation can be accordingly operated in such a manner that also when the vehicles deviate from a predetermined mutual position or phase, either to an increased extent or to a lesser extent, there is possible the operative association of the vehicles with the entrainment members at the transfer section or path.

Preferably the velocity of the further conveyor, likewise designed to carry out a revolving or circulating motion, is correlated to the revolving or circulating velocity of the clock conveyor in a predeterminate relationship. If the revolving velocity of the clock conveyor is selected to be greater than the revolving or circulating velocity of the further conveyor, then a vehicle which is moved by the further conveyor along the transfer section is overtaken by the entrainment member of the clock conveyor which is intended to be operatively associated with such vehicle and during such passing maneuver the vehicle is entrained by such entrainment member.

An advantageous design of the inventive overhead cable transport installation can be realized when the clock conveyor and the further conveyor possess a common drive or drive means which likewise is beneficially constituted by the drive for the travelling transport cable of the overhead cable transport installation. In this regard it is advantageous to arrange between the common drive and both unit or equivalent structure allowing for coordination or matching of the revolving velocities of the conveyors with that of the cable, in other words, enables influencing the mutual spacing or phase of the vehicles.

To avoid disturbances in the operation of the overhead cable transport installation, resulting from extreme shifts in the mutual spacing or phase of individual vehicles, it can be advantageous to provide at the inbound or arriving side of the vehicles, forwardly of the transfer section, means for monitoring the position or phase of the vehicles with respect to the entrainment members of the clock conveyor and then through the provision of further means to influence the revolving or circulating velocity of at least the clock conveyor as a function of a determined phase position. The further means for influencing the revolving or circulating velocity can be constituted, for instance, by the infinitely variable gearing or transmission unit.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the overhead cable transport installation, here shown as an aerial cableway, has been illustrated therein as is needed to enable one skilled in the art to readily understand the underlying principles and concepts of this invention.

Figure 1:
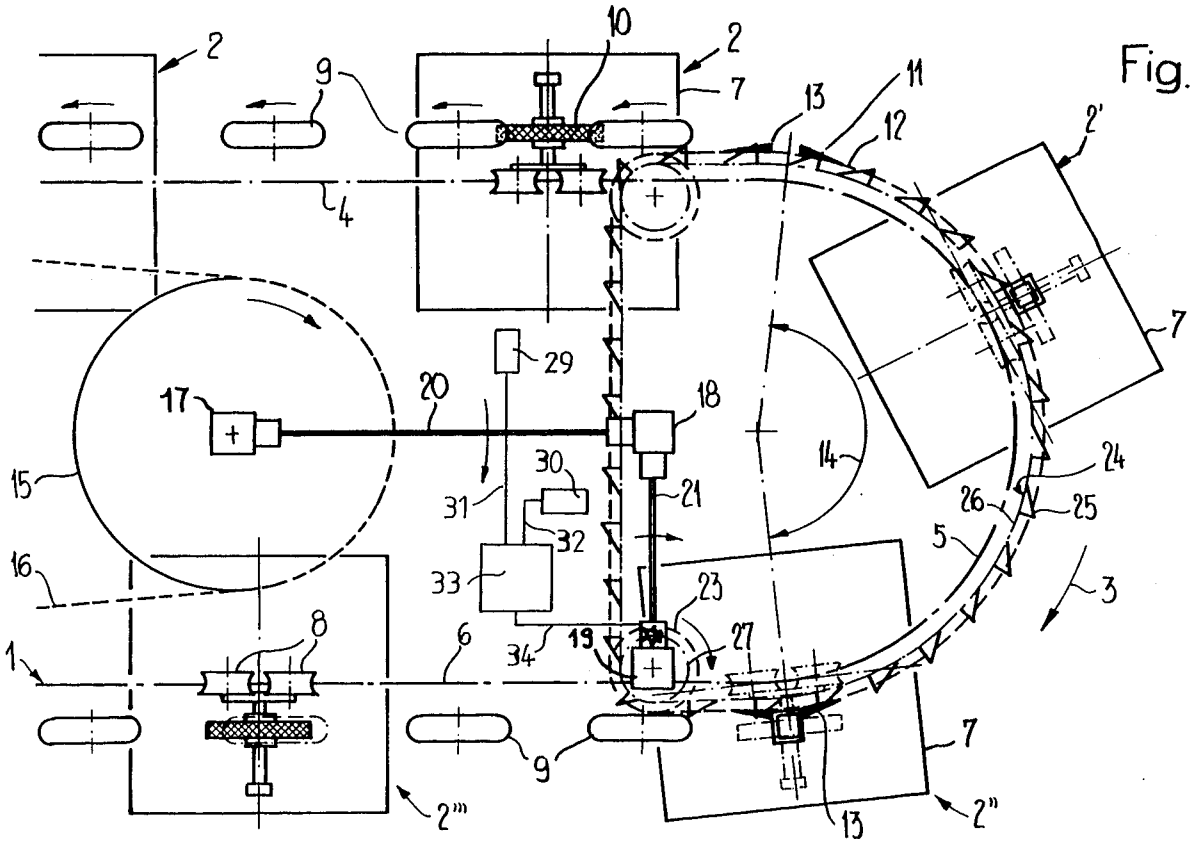
FIG. 1 illustrates in schematic plan view a portion of a station of an overhead cable transport installation, assumed to be an aerial cableway and constructed as a single cable transport system.
Figure 2:
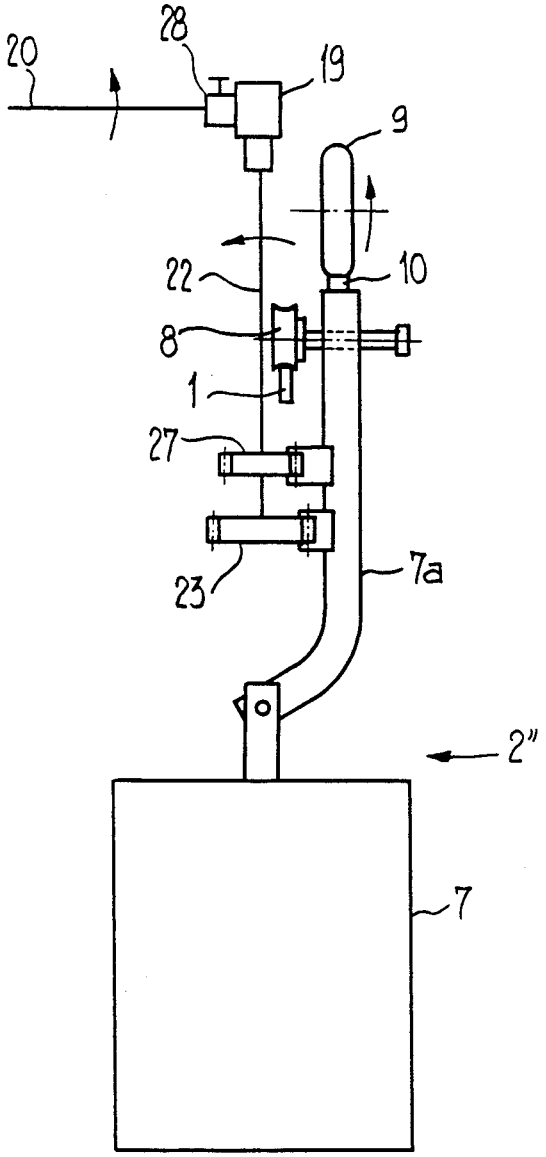
FIG. 2 is a schematic elevational view of a vehicle located at the end of the transfer section or path of the arrangement of FIG. 1.

In the showing of FIGS. 1 and 2 the therein depicted aerial cableway can be constituted by a gondola or cabin lift although other types of cable transport installations are equally contemplated, such as chair lifts. Furthermore, the overhead cable transport installation of the present invention can be advantageously used in other fields of application, for instance for transporting goods or materials. Thus, with that in mind, and while the exemplary embodiment is conveniently described in terms of transporting passengers, the expressions "disembarking " and "embarking", or equivalent terminology, as employed herein is to be construed in its broader sense as not simply meaning or confined to the exiting or entry of passengers, but also can be considered to mean, for instance, the point of loading or unloading, as the case may be, of materials or goods handled by the installation.

Turning attention now specifically to the drawings, it will be recognized that a conventional travelling rail or track system 1 extends through the depicted station or terminal located at a predetermined site of the vehicle conveying path, such as, for instance, at the base of a mountain by means of which such base station can be connected with another station located at some other predeterminate location or site, for instance, at a desired point up along the mountain, such as at an intermediate position or at the top of the mountain, by way of example. Vehicles 2 such as for instance, gondolas or cabins of the aerial cableway are supported in the depicted station at the travelling rail or track system 1 and these vehicles 2 are assumed to be conveyed in the direction of the arrow 3. The substantially U-shaped travel rail or track system 1 thus interconnects a substantially linear disembarking or exiting section or path 4 by means of a curved transfer section or path 5 with a likewise substantially linear embarking or entry section or path 6.

In the depicted exemplary embodiment and as shown in FIG. 2, each vehicle 2 will be seen to comprise a cabin or cabin structure 7 or equivalent conveyance structure which is supported upon the travel rail or track system 1 by a suitable carriage 8 or the like operatively connected with the suspension or support system *7a* of the corresponding vehicle 2. The drive of the vehicles 2 along the respective disembarking section 4 and the embarking section 6 occurs along such sections 4 and 6 by means of spatially fixedly arranged but rotatable friction wheels 9 or equivalent structure in conventional manner, for instance as disclosed in the aforementioned commonly assigned, co-pending U.S. application Ser. No. 07/061,623, filed June 15, 1987, and entitled "Overhead Cable Transport Installation, Especially Aerial Cableway", now U.S. Pat. No. 4,794,864, granted Jan. 3, 1989, to which reference may be readily had and the disclosure of which is incorporated herein by reference. The friction wheels 9, driven in any appropriate and thus not particularly illustrated fashion, act upon friction elements, here shown in the form of friction shoes 10 (FIG. 2) which are secured to the suspension or support systems or suspension means *7a* of the vehicles 2 and convey these vehicles 2 in the direction of the arrow 3.

Along the transfer section or path 5 there extends a conventional clock conveyor or conveyor device 11 which, for instance, comprises a chain or chain member 12 and here, for instance, two entrainment members 13 secured to the chain or chain member 12. The entrainment members 13 are spacedly arranged from one another at the chain 12 by an amount corresponding to the so-called clock spacing or distance 14. This clock spacing or distance 14 corresponds to a predeterminate reference or set spacing of the vehicles 2 at a predeterminate vehicle travel velocity, in other words, the predeterminate velocity of the clock conveyor 11.

In the embodiment of aerial cableway under discussion, here designed as a single cable conveying system, the support and travelling traction cable 16 or the like of the aerial cableway travels around a cable pulley or sheave 15 or equivalent structure. A shaft or shaft member 22 is in driving connection with the cable pulley 15 by means of the bevelled gearing units or transmissions 17, 18 and 19 as well as the shafts 20 and 21. The chain or chain member 12 of the clock conveyor 11 travels over a sprocket wheel 23 or the like which is rigidly connected for rotation in conjunction with the shaft or shaft member 22 and this chain 12 is driven by the sprocket wheel 23.

According to important aspects of the present invention, a further conveyor or conveyor device 24, is operatively associated with the transfer section or path 5. In the illustrated embodiment this further conveyor or conveyor device 24 extends, for instance, over the entire region of the transfer section or path 5 and comprises a revolving or circulating chain or chain member 26 which is equipped with driver elements or drivers 25. Meshing with the chain 26 is a further driving sprocket wheel 27 which is rigidly connected for rotation with the shaft or shaft member 22. The pitch diameter of the sprocket wheel 27 is smaller than that of the sprocket wheel 23. Consequently, the velocity of revolving or circulatory motion of the chains 12 and 26 are in a fixed relationship with respect to one another which is governed by the respective diameter of the sprocket wheels 23 and 27. In the embodiment under consideration the further conveyor 24 has a smaller velocity of revolving or circulatory motion than that of the clock conveyor 11. The reverse situation can be, however, established if desired by, for instance, selecting a different diameter relationship of the gears 23 and 27 as will be evident to those skilled in the art or by providing other appropriate measures to achieve such result.

The bevelled gearing or transmission system 19 comprises an infinitely adjustable gearing unit or gearbox 28 which enables altering the velocity of revolving or circulatory motion of the clock conveyor 11 in relation to the driving rotational speed of the cable pulley or sheave 15. The revolving or circulating velocity of the clock conveyor 11 can thus be placed in a predeterminate relationship to the actual cable velocity.

During operation of the single cable aerial cableway, the vehicles 2 arriving or inbounding at the disembarking section or path 4 are conveyed by the friction wheels 9 at the contemplated disembarking velocity in the direction of the transfer section or path 5. Upon arrival at the transfer section or path 5 the vehicles 2 are directly taken over and without coming to a standstill by the further conveyor 24 in that, in each case, a driver element or driver 25 comes into operative engagement or association with the suspension system or suspension means *7a* of the inbound vehicle 2. In the usual case, the revolving velocity of the further conveyor 24 is somewhat smaller than the vehicle disembarking velocity, that is to say, the velocity of the vehicles 2 delivered to the transfer section 5 which merges at the disembarking section or path 4. A vehicle, designated in FIG. 1 by reference character 2', under the action of the further conveyor 24, has already moved through part of the transfer section or path 5 in the direction of the arrow 3. At this transfer section or path 5, there has also arrived in the meantime an entrainment member 13 of the clock conveyor 11. The revolving velocity of the clock conveyor 11 is usually equal to the passenger disembarking velocity contemplated for the vehicles 2 and thus greater than that of the further conveyor or conveyor device 24. As a result, the entrainment member 14 of the clock conveyor 11 approaches the vehicle 2' during the further course of its conveying motion under the action of the further conveyor 24.

A vehicle 2'' which, viewed in the conveying direction towards the passenger embarking or entry section or path 6, is located immediately neighboring the vehicle 2' and which approaches the end of the transfer section 5, has, in the meantime, been overtaken by the second one of the entrainment member 13 of the clock conveyor 11. Hence, the entrainment member 13 has operatively engaged the suspension system *7a* of the vehicle 2', and by virtue of the greater velocity, has disengaged such vehicle 2'' from the driver element 25 which was previously effective thereat. Upon departure from the transfer section or path 5 this vehicle 2'' is transferred to the friction wheels 9 of the passenger embarking section or path 6 at a phase position which has been predetermined by the entrainment member 13. Between this vehicle 2'' and the vehicle 2''' which is moved directly forwardly of such vehicle 2'' there prevails the clock spacing 14, since the conveyor velocity at the passenger embarking section 6 is equal to the revolving velocity of the clock conveyor 11.

The clock spacing of the vehicles 2 can be attained even in the case of relatively great deviations of the arriving or inbound vehicles as concerns the predetermined phase position, since the entrainment members 13 of the clock conveyor 11 can operatively engage vehicles 2 throughout the entire length or region of the transfer section or path 5.

If the predeterminate phase position should be altered either continuously or briefly, then this can be accomplished by altering the transmission ratio of the gearing or transmission unit 28 during operation of the aerial cableway.

As noted previously, it is also possible to drive the further conveyor 24 at a greater velocity than the clock conveyor 11 so that an entrainment member thereof in the normal case can be overtaken along the transfer section or path 5 by a vehicle 2 which is being transported by the further conveyor 24.

It is also possible to provide means, such as the depicted vehicle sensor 29 for monitoring the phase position of the vehicles 2, and further means, such as the entrainment member sensor 30 for monitoring the position of the entrainment members 13 in relation to the position of the vehicles 2. These sensors 29 and 30 may be conventional type of sensors, such as infrared sensors containing an infrared emitter and infrared receiver as is well known in the infrared sensor detecting art. Each of these sensors 29 and 30 deliver signals representative of the position of the vehicles 2 and the entrainment members 13 by means of the related lines 31 and 32 to a suitable controller or control device 33 which appropriately determines whether these sensor signals are in a predetermined time relationship to one another or within a prescribed time window with respect to one another and if that is not the case then there is delivered by means of the line 34 a suitable correcting signal to the gearing or transmission unit 28 so that, for instance, the revolving velocity of the clock conveyor can be appropriately regulated or influenced as a function of the detected mutual phase position or spacing of the relevant vehicles and entrainment members with respect to one another.

As already previously mentioned the invention is not limited to a gondola-type of aerial cableway and other conveyance systems are contemplated such as an aerial cableway in the form of a chair lift. Also as noted heretofore the passenger embarking path and the passenger disembarking path can be analogously construed as respective loading and unloading sections or paths of a material conveyance installation.

Finally, it is still further mentioned that although in the illustrated exemplary embodiment the revolving or circulating velocity of the clock conveyor is equal to the vehicle travel velocity at the passenger disembarking section and the passenger embarking section, the revolving velocity of the clock conveyor can also be appreciably greater. For instance, this is also then possible if the vehicles at the start of the transfer section or path are accelerated and at their end or terminal portion are decelerated, as such has been disclosed in the aforementioned commonly assigned, co-pending U.S. Application Ser. No. 07/132/897, filed Dec. 14, 1987, entitled "Overhead Cable Transport Installation Containing a Transfer Section Between a Disembarking Station and an Embarking Station" to which reference may be readily had and the disclosure of which is incorporated herein by reference.

While there are shown and described present preferred embodiments of the invention, it is to be distinctly understood that the invention is not limited thereto, but may be otherwise variously embodied and practiced within the scope of the following claims. Accordingly,

What I claim is:

1. An overhead cable transport installation, especially an aerial cableway, comprising:

means defining a disembarking section in the station;

means defining an embarking section in the station;

means defining a transfer section in a station;

said transfer section interconnecting the disembarking section and the embarking section;

means for continuously moving a plurality of vehicles through the disembarking section, the transfer section and the embarking section;

said means for continuously moving said vehicles including a revolvingly driven clock conveyor for moving the vehicles through the transfer section;

said revolvingly driven clock conveyor possessing a predeterminate revolving velocity;

a driven further conveyor provided at the region of at least part of the transfer section of the station;

both said revolvingly driven clock conveyor and said further driven conveyor comprising an endless flexible element and entrainment means carried by both the endless flexible elements of said driven conveyors for cooperation with vehicles while in the region of said transfer section;

said driven further conveyor possessing a predeterminate conveying velocity differing from the predeterminate revolving velocity of the revolvingly driven clock conveyor and having a plurality of said entrainment means arranged in spaced relation over the length thereof; and said further driven conveyor engaging each vehicle leaving said embarking section upon entry into said transfer section and transporting said vehicle thereon until said vehicle is brought into cooperative relationship with the entrainment means of the revolvingly driven clock conveyor.

2. The overhead cable transport installation as defined in claim 1, wherein:

said driven further conveyor possesses a predeterminate conveying velocity which is less than the predeterminate revolving velocity of the revolvingly driven clock conveyor so that an entrainment means of the revolvingly driven clock conveyor can overtake a vehicle along the transfer section.

3. The overhead cable transport installation as defined in claim 1, further including:

means for revolvingly driving the driven further conveyor at a velocity which is in a predeterminate relationship to the revolving velocity of the revolvingly driven clock conveyor; and the revolving velocity of the revolvingly driven clock conveyor being greater than the velocity of the driven further conveyor.

4. The overhead cable transport installation as defined in claim 3, wherein:

said revolvingly driving means for driving the driven further conveyor comprise a common drive which is operatively connected with the revolvingly driven clock conveyor and said driven further conveyor.

5. The overhead cable transport installation as defined in claim 4, wherein:

said means for continuously moving the vehicles comprises a cable pulley;

said common drive constituting a drive of the cable pulley; and an infinitely adjustable transmission means arranged between the cable pulley and both the driven further conveyor and the revolvingly driven clock conveyor.

6. The overhead cable transport installation as defined in claim 4, wherein:

said driven further conveyor comprises a revolving chain defining said endless flexible element thereof; and a plurality of driver elements coacting with the vehicles and secured to the revolving chain.

7. The overhead cable transport installation as defined in claim 6, wherein:

each of said vehicles comprises a suspension means; and driver elements of the driven further conveyor and said entrainment means of said revolvingly driven clock conveyor being engageable with said suspension means at said vehicles.

8. The overhead cable transport installation as defined in claim 1, wherein:

said driven further conveyor comprises a revolving chain defining said endless flexible element thereof; and a plurality of driver elements coacting with the vehicles and secured to the revolving chain.

9. The overhead cable transport installation as defined in claim 1, further including:

means for monitoring the phase position of the vehicles with respect to the entrainment means of the revolvingly driven clock conveyor; and means for controlling the revolving velocity of at least the revolvingly driven clock conveyor as a function of the monitored phase position of the vehicles with respect to the entrainment means of the revolvingly driven clock conveyor.

10. The overhead cable transport installation as defined in claim 1, wherein:

said driven further conveyor extending substantially throughout the entire length of the revolvingly driven clock conveyor.

11. An overhead cable transport installation, especially an aerial cableway, comprising:

means defining a disembarking section in the station;

means defining an embarking section in the station;

an endless overhead transport cable extending between said disembarking section and said embarking section;

means defining a transfer section in a station;

said transfer section interconnecting the disembarking section and the embarking section;

means for continuously moving a plurality of vehicles through the disembarking section, the transfer section and the embarking section;

said means for continuously moving said vehicles including a revolvingly driven clock conveyor for moving the vehicles through the transfer section;

said revolvingly driven clock conveyor possessing a predeterminate revolving velocity;

a driven further conveyor provided at the region of at least part of the transfer section of the station;

said driven further conveyor possessing a predeterminate conveying velocity differing from the predeterminate revolving velocity of the revolvingly driven clock conveyor so that an entrainment means of the revolvingly driven clock conveyor and a vehicle moved by the driven further conveyor can be brought into cooperative relationship with one another;

both said revolvingly driven clock conveyor and said further driven conveyor comprising an endless flexible element and entrainment means carried by both the endless flexible elements of said driven conveyors for cooperation with vehicles while in the region of said transfer section;

common drive means connected to both of said driven conveyors;

said common drive means including a cable pulley;

said transport cable travelling over said cable pulley;

an infinitely adjustable transmission means arranged between the cable pulley and both the driven further conveyor and the revolvingly driven clock conveyor;

said driven further conveyor possessing a predeterminate conveying velocity differing from the predeterminate revolving velocity of the revolvingly driven clock conveyor and having a plurality of said entrainment means arranged in spaced relation over the length thereof; and said further driven conveyor engaging each vehicle leaving said embarking section upon entry into said transfer section and transporting said vehicle thereon until said vehicle is brought into cooperative relationship with the entrainment means of the revolvingly driven clock conveyor.

* * * * *